US005290189A

United States Patent [19]

Hemsath et al.

[11] Patent Number: 5,290,189

[45] Date of Patent: Mar. 1, 1994

[54] HIGH TEMPERATURE INDUSTRIAL HEAT TREAT FURNACE

[75] Inventors: Klaus H. Hemsath, Toledo; James E. Lyon, Perrysburg, both of Ohio

[73] Assignee: Gas Research Institute, Chicago, Ill.

[21] Appl. No.: 112,145

[22] Filed: Aug. 26, 1993

[51] Int. Cl.[5] ..... F27D 1/18

[52] U.S. Cl. ..... 432/242; 432/251; 432/205; 432/17.6

[58] Field of Search ..... 432/242, 205, 247, 176, 432/199, 146, 251

[56] References Cited

U.S. PATENT DOCUMENTS

| | | | |
|---|---|---|---|
| 4,512,738 | 4/1985 | Hartmann | 432/251 |
| 4,569,508 | 2/1986 | de Graaf | 432/251 |
| 4,787,844 | 11/1988 | Hemsath | 432/242 |
| 4,789,333 | 12/1988 | Hemsath | 432/234 |
| 4,830,610 | 5/1989 | Hemsath | 432/175 |
| 4,840,559 | 6/1989 | Hemsath | 432/3 |
| 4,854,860 | 8/1989 | Hemsath | 432/5 |
| 4,854,863 | 8/1989 | Hemsath | 432/176 |
| 4,891,008 | 1/1990 | Hemsath | 432/148 |
| 5,119,395 | 6/1992 | Hemsath et al. | 432/242 |

*Primary Examiner*—Henry C. Yuen

*Attorney, Agent, or Firm*—Frank J. Nawalanic

[57] ABSTRACT

Modifications are provided to a standard, batch type industrial heat treat furnace of a hot wall design which permit the furnace to be operated efficiently at high temperatures. The furnace is of a cylindrical design having a forward heat treat chamber and a rearward plenum chamber with a flat bulkhead plate in-between the chambers. The bulkhead has exit and inlet openings permitting wind mass to flow to the heat treat chamber and back to the plenum chamber. The bulkhead has a plurality of radially extending slits formed therein which permit the bulkhead to remain flat despite temperature and pressure gradients resulting in expansion/-contraction of the bulkhead. Additionally, the furnace includes a closed end muffle within the heat treat chamber into which work to be heat treated is placed. A water cooled spring biasing support is provided for the closed end of the muffle to resist downward deformation of the muffle at high temperatures. The furnace additionally includes a heat shield circumscribing the furnace casing to provide a cooling air space for preheating burner combustion air while minimizing heat losses and the cost of furnace insulation.

29 Claims, 4 Drawing Sheets

HIGH TEMPERATURE INDUSTRIAL HEAT TREAT FURNACE

This invention relates generally to gas fired "hot wall" industrial heat treat furnaces and more particularly to improvements in such furnaces when operated at temperatures which are considered high in the heat treat furnace art.

The invention is particularly applicable to and will be described with specific reference to a muffle type, industrial heat treat furnace utilizing fibrous "hot wall" type insulation. However, the invention is not necessarily limited to muffle type furnaces but has application in several respects to any batch type, high temperature industrial heat treat furnace having fibrous insulation secured to the furnace casing.

INCORPORATION BY REFERENCE

The following patents all relate to the specific furnace of the present invention and all patents are incorporated herein by reference and form a part hereof so that the specifications hereof need not define nor describe in detail certain aspects of the furnace or operation thereof which are disclosed in the following patents:

| Patent Number | Title | Date Issued |
|---|---|---|
| 4,787,844 (Hemsath) | Seal Arrangement For High Temperature Furnace Applications. | 11-29-88 |
| 4,789,333 (Hemsath) | Convective Heat Transfer Within An Industrial Heat Transfer Furnace. | 12-6-88 |
| 4,840,559 (Hemsath) | Seal Arrangement For High Temperature Furnace Applications. | 6-20-89 |
| 4,854,860 (Hemsath) | Convective Heat Transfer Within An Industrial Heat Transfer Furnace. | 8-08-89 |
| 4,854,863 (Hemsath) | Convective Heat Transfer Within An Industrial Heat Transfer Furnace. | 8-08-89 |
| 4,830,610 (Hemsath) | High Temperature Convection Furnace. | 5-16-89 |
| 4,891,008 (Hemsath) | High Temperature Convection Furnace. | 1-02-90 |
| 5,119,395 (Hemsath, Lyon) | Interlock Feed-Through And Insulator Arrangement For Plasma Arc Industrial Heat Treat Furnaces | 6-2-92 |

BACKGROUND

This invention is limited to batch-type, industrial heat treat furnaces. Batch-type furnaces are generally constructed in one of two ways. For vacuum applications which are typically high temperature furnace applications, the furnace is usually constructed with a water jacket which keeps the outer furnace casing cool to the touch and allows the use of elastomer seals to maintain a very secure, gas tight door connection. This construction is expensive and the cost dramatically increases with the size of the furnace. The other type of furnace construction and the type of construction to which this invention relates uses a thin, gas-tight furnace casing, the interior of which is lined with insulation (fibrous or brick). Seals for such furnace, because of the heat generated, typically comprise a ceramic type rope seal and a variety of door sealing mechanisms exist within the art. Though such seals are effective, they cannot achieve the seal integrity of the elastomer seals used in the vacuum furnace. Recently, this type of furnace, which will hereafter be termed "standard atmosphere furnace" has been operated at higher and higher furnace temperatures despite the lack of a water jacket casing. Such furnace temperatures can exceed slightly over 2000° F. As used herein and throughout this specification, "high temperature" with respect to industrial furnace operation means temperatures in excess of about 1700°–1750° F. This temperature is believed to be a temperature generally accepted within the art as a high temperature furnace application. When standard atmosphere construction furnaces are operated at high temperature, the insulation on the furnace casing must be dramatically increased so that the casing temperature does not exceed about 150° F. Besides the expense of added insulation, because the furnace insulation is applied to the inside of the furnace, the furnace size increases. Thus a larger and more expansive furnace casing is required.

All batch-type furnaces typically use a fan for directing wind mass about the work. The direction of the wind mass is achieved by baffles. It is generally understood within the art that heating of the work is achieved at the low temperature end by convection heat transfer and at the high temperature end by radiation heat transfer because little heat transfer occurs by convection at elevated temperatures. In the furnace of the present invention and as defined in some of the patents incorporated by reference, high speed jet impingement is utilized to boost the temperatures over which convective heat transfer can effectively occur. However, whether high speed jet impingement is or is not used, at high furnace temperatures baffles for directing the wind mass can distort. This distortion can effect the performance of the furnace in that the work may not be heated uniformly because of baffle distortions. The problem is more severe if the wind mass is pumped through jet orifices for heating the work by impingement. Distortion of the baffling then can affect the angle at which the jets impinge the work creating localized, hot spots etc.

Batch furnaces are produced in a variety of shapes. One type of furnace construction typically used in the art can be defined as a cylindrical furnace with a closed end. The work is simply loaded through the open end of the cylindrical tube (which is insulated) and the door seals the furnace interior which is then heated. To achieve heating and cooling of the work, a f an plenum arrangement is typically constructed at the rear end of the furnace.

One specific type of a batch furnace may be generally described as a closed end cylindrical tube, the interior of which is lined with insulation and a rotatable door or vertically slidable door is provided so that work can be placed into and out of the furnace from the open end of the cylindrical tube. In this type furnace, the fan is provided at the closed rear-end and a plenum plate or, as is used herein, a bulkhead is provided adjacent the fan. The bulkhead has a central under-pressure opening and, spaced radially outwardly therefrom, an exit opening so that the wind mass developed by the fan between the bulkhead and the end of the furnace is pumped through the exit opening and returns to the fan through the under-pressure central opening. When such furnaces are operated at high furnace temperatures, thermal expansion and fan pressure cause the bulkhead to expand and contract with the result that the bulkhead distorts. This distortion can adversely influence the wind distribution pattern about the work as discussed generally above.

Of the various types of industrial furnace constructions, there is a furnace construction conventionally referred to as a muffle furnace. In essence, a muffle furnace can be viewed as a tube within a tube. The work which is to be heat treated is placed within a tube and the tube itself is heated which heat is then radiated to heat the work inside the muffle. To avoid any difficulties in semantics, batch coil annealing apparatus can be viewed as a muffle furnace and the imperforate shell disclosed in my prior patents can also be viewed as a muffle. For batch furnace application, the muffle is viewed as a closed end cylindrical tube while a continuous or semicontinuous furnace the muffle is an open-ended tube within a furnace through which work travels. The applications are entirely different and "muffle" as used herein means a muffle furnace for batch work processing. It can be appreciated that the muffle is a thin wall, rather large, imperforate cylindrical tube which at high furnace temperatures tends to distort. This distortion can effect the heat distribution pattern which the outside of the muffle is subjected to. This can produce localized hot spots relative to the work.

SUMMARY OF THE INVENTION

Accordingly, it is a principal object of the invention to provide in a batch-type, cylindrical, high temperature furnace of the standard atmospheric construction type, furnace apparatus or improvements which enable the furnace to efficiently operate at high furnace temperatures.

This object along with other features of the invention is achieved in a cylindrical, high temperature industrial heat treat furnace which includes a heat treat section defined by a generally cylindrical furnace casing having a circular forward end and a flanged, rearward end with the forward end being the loading end of the furnace. The furnace includes a plenum section defined by a generally cylindrical plenum casing having a circular flanged forward end and a rearward end with the rearward end being the rear end of the furnace and the flanged forward end of the furnace casing and the flanged rearward end of the plenum casing abutting one another in a secured manner. A circular bulkhead is positioned inbetween the flanged ends and defines a heat treat chamber extending on one side of the bulkhead within the heat treat section and a plenum chamber extending from the opposite side of the bulkhead within the plenum section and the bulkhead has a central, underpressure opening and a pressure exit opening spaced radially outwardly from the central opening. A fan mechanism within the plenum chamber develops a source of pressurized wind mass within the plenum chamber which leaves the plenum chamber through the pressure exit opening into the heat transfer chamber and returns to the plenum chamber through the central opening. A burner arrangement is provided for heating the wind mass to an elevated temperature and a sealing mechanism at the flanged ends is provided for sealing the circular outer edge of the bulkhead within the flanged ends while permitting the bulkhead edge to radially move within the flanged ends to accommodate thermal expansion and contraction. At least one radial slit is formed in the bulkhead which slit extends to the outer edge from a position radially outwardly from the pressure exit opening whereby the bulkhead remains flat despite expansion and contraction of the bulkhead during operation of the furnace resulting from radial temperature gradients within the bulkhead from the casing to the furnace chamber and/or alternately heating and cooling of the bulkhead during the heat treat process and/or pressure exerted on one side of the bulkhead from the fan.

In accordance with a more specific feature of the invention a plurality of radial slits are formed and circumferentially spaced about the bulkhead and the bulkhead by virtue of the slit configuration remains flat during furnace operation. In accordance with another aspect of the invention, the slits are spaced in equal circumferential increments about the bulkhead. However, in accordance with another aspect of the invention at least two diametrically opposed tangentially fired burners are place within the plenum chamber and at least additional first and second radial slits circumferentially spaced 180° from one another are provided with each additional slit spaced closely adjacent one of the equal circumferentially spaced slits whereby deformation of the bulkhead attributed to hot spots formed by the burner firing patterns is alleviated.

In accordance with still another aspect of the invention, a cover mechanism is provided for covering each slit so that the wind mass developed by the fan in the plenum chamber does not substantially exit the plenum chamber through the slits. The cover arrangement includes a pinned plate within an oversized hole connection for fastening the cover to the bulkhead to permit the covers to be snugged against the flanged ends of the plenum and heat treat sections to minimize wind mass flow through the slits during furnace operation.

In accordance with yet another aspect of the invention, the furnace includes a cylindrical, thin, imperforate shell, closed end muffle which is disposed within the heat treat chamber with the open end of the muffle approximately aligned with and supported by the forward end of the heat treat section. The closed end of the muffle is spherically shaped and an anchor pin is secured to and extends from the closed end with a pivot bar attached, at one of its ends, to the anchor pin in a pivotal manner. A spherical collar is mounted on top of the heat treat casing for swiveling with the collar having a central opening aligned with an opening through the heat treat casing into the heat treat chamber and the pivot bar extends through the collar opening with an adjustable compression member mounted on the pivot bar above the collar. A spring is effectively compressed between the compression member and the heat treat casing by which the closed end of the muffle is pulled upwardly by the compression force of the spring whereby the muffle is supported against downward deflection at elevated temperatures by the spring to resist downward movement of the muffle caused by thermal expansion at high furnace temperature.

In accordance with yet a further aspect of the invention, the pivot rod is hollow over that distance which the pivot rod extends beyond the heat treat casing and a water tube within the hollow portion of the pivot rod is connected to a water supply inlet and so that the water tube and pivot bar define an annular water space therebetween. A water outlet is provided in fluid communication with the annular water space generally adjacent the water inlet whereby the spring is maintained cool outside the heat treat chamber without adversely affecting the temperature within the heat treat chamber.

In accordance with yet another feature of the invention with respect to the invention when applied to a muffle, batch furnace, a plurality of pressure exit openings are spaced at equal circumferential increments about the bulkhead and a plurality of longitudinally-extending, jet distributor tubes extend from the pressure exit openings into the heat treat chamber to circumscribe the muffle disposed therein with each distributor tube containing a plurality of orifices orientated so that jet streams of the pressurized wind mass impinge the muffle whereby the distributor tubes maintain their proper position at elevated furnace temperature because the bulkhead has remained flat thus avoiding uneven heat distribution inputted into the muffle.

In accordance with still yet another aspect of the invention, the furnace includes a heat treat shield circumscribing a substantial portion of the circumference of the heat treat section and extending substantially the length of the heat treat section so that the heat shield and the heat treat casing form an annular cooling space therebetween. The cooling space is in fluid communication at the rearward end of the heat treat section with the burner means in the plenum chamber and in fluid communication at the forward end of the heat treat section with combustion air so that the combustion air supplied to the burners is preheated by the heat treat casing while simultaneously cooling the heat shield to minimize furnace insulation otherwise required to keep heat treat casing cool when the heat treat chamber is at elevated temperatures at excess of about 1700° F.

In accordance with yet another feature of the invention with respect to the invention when applied to a muffle batch furnace, a plurality of pressure exit openings are spaced at equal circumferential increments about the bulkhead and a plurality of longitudinally extending jet distributor tubes longitudinally extend from the pressure exit openings into the heat treat chamber to circumscribe the muffle disposed therein with each distributor tube containing a plurality of orifices orientated so that jet streams of the pressurized wind mass impinge the muffle whereby the distributor tubes maintain their proper position at elevated furnace temperature because the bulkhead has remained flat thus avoiding uneven heat distribution inputted into the muffle.

It is thus an object of the invention to provide improvements in standard atmosphere construction furnace which enable the furnace to operate at high temperature.

It is another object of the invention to provide a cooling arrangement for a standard atmosphere construction furnace to reduce furnace insulation otherwise required and also to preheat combustion air supplied to the burners.

It is yet another object of the invention to provide a spring loaded support for load relief to a batch type muffle furnace to minimize downward deflection of the muffle at elevated furnace temperatures.

It is still yet another object of the invention to provide a mechanism for maintaining a generally circular plate flat at elevated temperatures despite radial temperature gradients which would otherwise thermally deform or bend the plate.

It is yet another object of the invention to provide a mechanism in a muffle type furnace employing jet distributor tubes which direct jet streams against the outside of the muffle while maintaining the geometric spacing between muffle and tubed at elevated temperatures.

It is a more general object of the invention to provide a mechanism for maintaining the proper geometry or part spacing or position for a batch type muffle furnace operated at elevated or high furnace temperature.

It is another more specific object of the invention to provide in a hot wall furnace where a temperature gradient exists between the outside temperature of the casing and the hot inside furnace temperature adjacent the furnace insulation and where the interior of the furnace is alternately subjected to high temperatures and relatively cold temperatures when the work to be cooled is a heat treat process, to provide a thermal expansion arrangement for maintaining flatness of plates, bulkheads and the like which extend from the furnace casing inward to the furnace interior.

It is still yet another object of the invention to provide a simple and economical batch type, heat treat furnace capable of operating at high furnace temperatures.

It is yet another object of the invention to provide a heat treat furnace which by virtue of its fibrous furnace insulation construction is inexpensive to manufacture but capable of operating at high furnace temperatures.

These and other objects of the present invention will become apparent to those skilled in the art upon a reading of the detailed description of the invention set forth below taken together with the drawings which will be described at the next section.

BRIEF DESCRIPTION OF THE DRAWINGS

The invention may take physical form in certain parts and arrangement of parts, a preferred embodiment of which will be described in detail and illustrated in the accompanying drawings which form a part hereof and wherein.

DETAILED DESCRIPTION OF THE INVENTION

Figure 1:
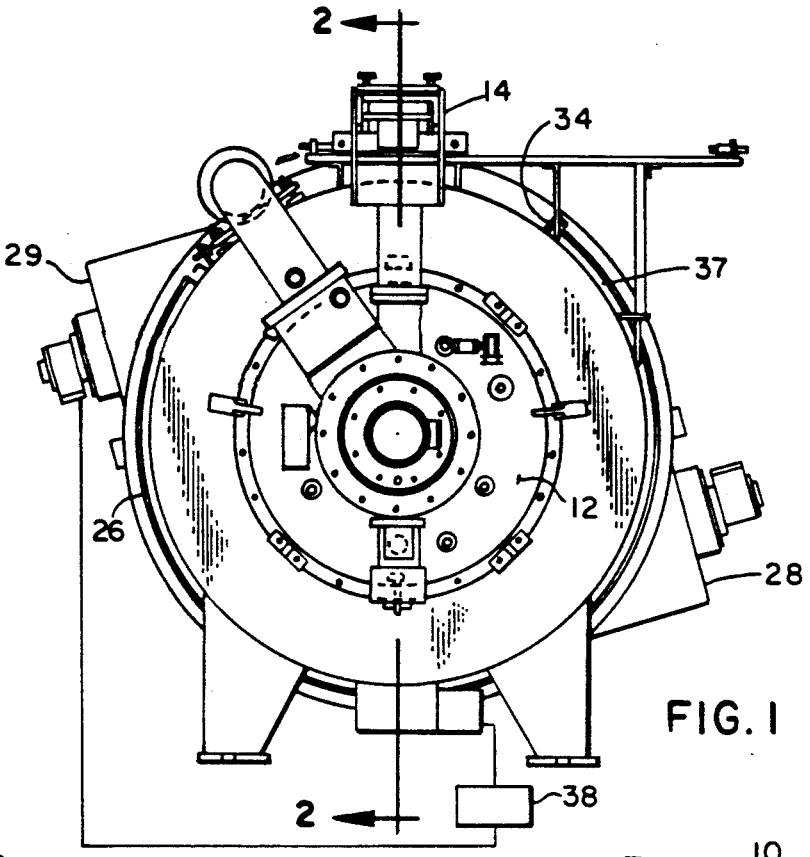
FIG. 1 is an end view of the front of the furnace of the present invention.
Figure 2:
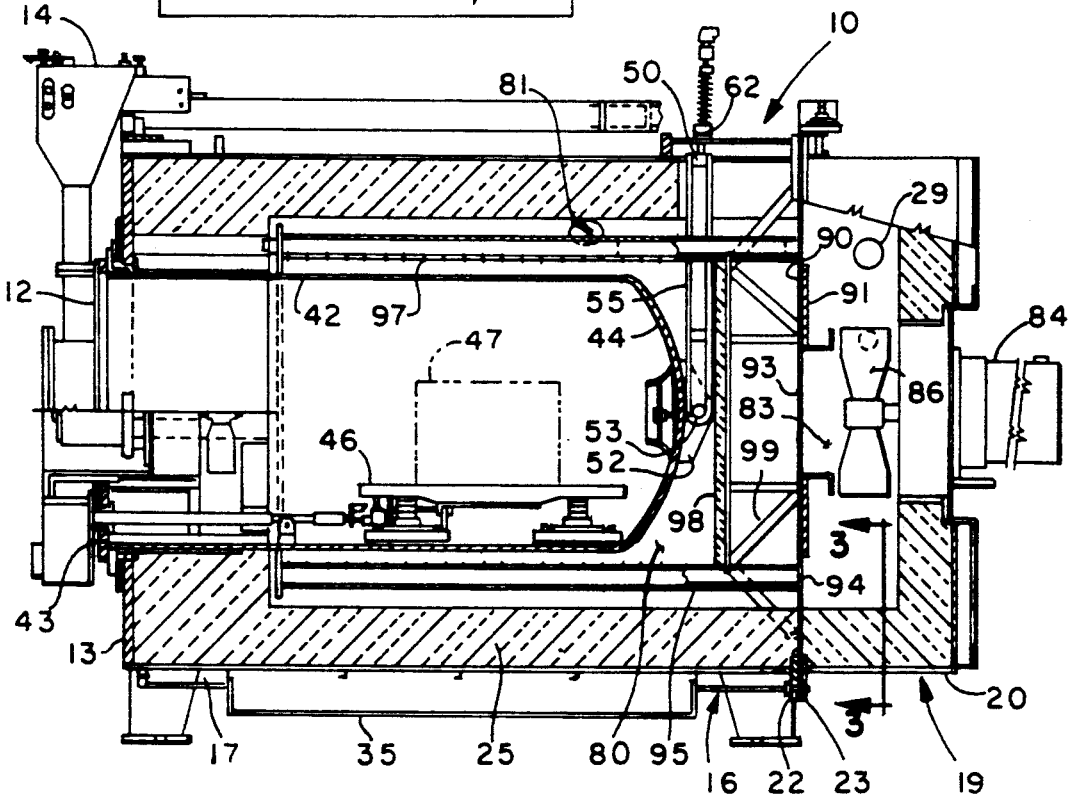
FIG. 2 is a longitudinally sectioned view of the furnace shown in FIG. 1 taken along the lines 2—2 of FIG. 1.

Referring now to the drawings wherein the showings are for the purpose of illustrating the preferred embodiment of the invention and not for the purpose of limiting same, there is shown in FIGS. 1 and 2 a cylindrical, batch-type, industrial heat treat furnace 10 which is specifically designed to be operated at high furnace temperatures in excess of about 1700°-1750° F. and is of a "hot wall" design. The prior patents incorporated herein by reference and defined above can and should be resorted to for a more detailed description of the invention than that which will be provided herein.

In furnace 10 there is a water cooled, elastomer sealed door 12 at the furnace front end 13 which moves in a straight line from an open to a closed position and is carried by a track mechanism 14. Furnace 10 generally includes two thin walled (3/16-⅜) plates which are welded together to be cylindrical in configuration. More specifically, there is a heat treat section 16 defined by a cylindrical heat treat casing 17 and there is a plenum section 19 defined by a cylindrical plenum casing 20. Heat treat section 16 has a flanged rearward end 22 and plenum section 19 has a flanged forward end 23 which are adjoined together in a specific manner which will be described hereafter. Secured to the interior of heat treat casing 17 and plenum casing 20 and extending radially inwardly and also along the longitudinal direction of furnace 10 is conventional furnace insulation 25 (see my prior patents for example U.S. Pat. No. 4,789,333). In the preferred embodiment, this insulation is a conventional fibrous insulation made up of blocks (not shown) fitted to one another and secured to the casing by appropriate studs, etc. Alternatively, and within the scope of the invention, furnace 10 can be lined with fire brick.

THE HEAT SHIELD

The construction of furnace 10 as thus far described is what is conventionally known in the art as a "hot wall" furnace. In such constructions, casings 17, 20 are designed so as not to exceed temperatures of about 150° F. When furnace 10 is operated at the high temperature of the present invention, additional insulation 25 must be added to maintain casing section temperature. Since the insulation is added to the interior of furnace 10, the diameter of casings 16, 20 must be increased. Thus the cost of furnace 10 rises twofold. First, there is the added cost of the additional insulation and second, there is the added cost of making larger diameter casings. To alleviate this problem, a heat treat shield 26 is provided.

Figure 3:
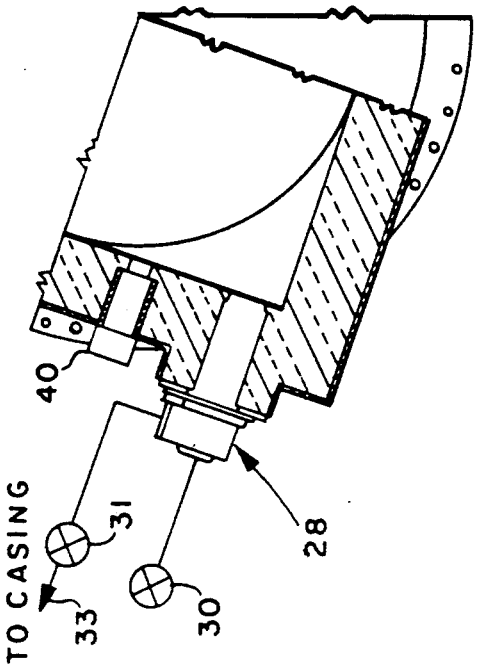
FIG. 3 is a section detail showing the mounting of the burners in the furnace of the present invention taken along lines 3—3 of FIG. 2.

Heat treat shield 26 is only partially shown in FIGS. 1 and 2. However, the construction, function and operation of heat treat shield 26 will be readily apparent to those skilled in the art. It is a specific feature of the invention that the high furnace temperature is achieved for cost, operating and maintenance considerations by use of gas fired burners. In furnace 10 a pair of tangential, gas fired burners 28, 29 are used. Gas fired burners 28, 29 shown in FIGS. 1, 2 and 3 are mounted in plenum section 19 and f unction to heat the wind mass developed within plenum section 19. Burners 28, 29, as best shown perhaps in FIGS. 1 and 3, are mounted 180° apart within plenum section 19 so that their products of combustion are tangentially fired within plenum section 19 to swirl about plenum section 19. Tangentially fired burners are, of course, conventional and well known in the art. Each burner 28, 29 has a conventional valve train (not shown) which operates to meter gas through gas valve 30 and combustion air through air valve 31 to burners 28, 29. Air valve inlet, shown diagrammatically by reference numeral 33 (FIG. 3) is in fluid communication with any suitable manifold duct arrangement (not shown) in turn in fluid communication with the longitudinal rearward end of heat treat shield 26.

As best shown in FIG. 1, heat treat shield 26 is a cylindrical gas-tight casing concentric with and circumferentially extending about substantially all of heat treat casing 17 and plenum casing 20. The top portion of casing 17, 20 is exposed and heat treat shield 26 is grasped at the top of casings 17, 20 by a pair of angular supports 34 extending the length of furnace 10. Heat treat shield 26 is supported at its bottom by a support duct 35 that also serves as collecting duct for the preheated combustion air. Thus heat treat shield 26 and heat treat casing 17 and plenum casing 20 form therebetween an annular cooling space 37. As already noted, rearward end of support duct 35 is in fluid communication with burner air inlet valve 31 by means of combustion air blower 38.

Irrespective of the placement of air pump 38, the operation of heat treat shield 26 should now become apparent to those skilled in the art who understand that at high temperatures, gas fired burners operate significantly more efficiently with preheated combustion air. Thus, heat treat shield 26 not only functions as a shield reducing the temperature of casings 17, 20 by virtue of its placement around the furnace, but more importantly, combustion air is drawn from duct 35 and pushed by air pump 38 to burners 28, 29 to accomplish two functions. First, the movement of air at ambient temperatures within cooling space 37 significantly enhances the cooling of heat treat casing 17 and plenum casing 20. Just as important, however, is the fact that as the combustion air travels peripherally along the diameter of furnace 10 through cooling space 37 it will be heated and in the process thereof, results in preheated combustion air which is supplied to burners 28 and 29. Furnace heat losses are largely eliminated. Conventional control mechanisms will operate valve 31 to regulate airflow within cooling space 37 by itself or in conjunction with air pump 38. From cost considerations, the addition of heat treat shield 26 is less expensive without considering the cost of a heat exchange mechanism otherwise required to preheat the combustion air to the burners.

Also, in furnace 10, and as best shown in FIG. 3, a tangentially mounted cooling jet 40 is also provided. Cooling jet 40 can be used in a conventional sense in that when the work within furnace 10 is to be cooled, cooling air can be supplied to plenum section 19. Cooling jet 40 can also be used to supply additional combustion air to burners 28, 29 in a "boost" or "high output" condition of the burners. In either instance, cooling jet 40 can be valved (not shown) into fluid communication with cooling space 37 which of course, would be necessary should cooling jet 40 supply additional preheated combustion air to burners 28, 29. It is also possible that the natural aspiration of burners 28, 29 could be utilized so that burners 28, 29 by means of gas pressure, will act to draw or pull combustion air through cooling space 37. This could obviate the need of air pump 38 or reduce the size of the pump. It is, of course, to be appreciated by those within the art that this particular feature of the invention is applicable to any cylindrical, batch-type, hot wall furnace and is not limited to the particular furnace construction used in this invention.

THE MUFFLE SUPPORT

Cylindrical furnace 10 of the present invention employs a thin, imperforate, cylindrical shell member or muffle 42 which is best shown in the general furnace arrangement of FIG. 2. Reference should be had to my prior U.S. Pat. Nos. 4,787,844 and 4,840,559 for a more detailed explanation of muffle 42 than what will be provided herein.

Muffle 42 is a closed end cylindrical tube having an open forward end 43 secured to furnace front end 13 and a closed end 44 which could be circular or straight walled in configuration, but preferably is hemispherical since muffle 42, acts as a pressure vessel i.e., a vacuum is drawn therein as described in my prior application. Within muffle 42 is a specific type of hearth 46 described in my prior U.S. Pat. No. 5,119,395. Reference should be had to the '395 patent for a detailed description of the interlock, hearth support, etc. It can be envisioned that when work, indicated by phantom lines 47, is placed on hearth 46 there is a downward load placed on muffle 42 even though the load is distributed by the hearth supports. It can or must be appreciated that muffle 42 has to have some freedom to thermally expand and contract during typical heat treat cycles. That is, if muffle 42 was firmly fixed at both ends to heat treat casing 17 the expansion contraction of muff le 42 relative to heat treat casing 17 would result in failure of either heat treat casing 17 or muffle 42. At the same time, when furnace 10 is operating at high temperatures, there is concern that muffle 42 will distort excessively downwardly because of weight of work 47. As will be explained later, this could effect heat transfer rates imparted to muffle 42 in the sense of "hot spots." To counteract any tendency of muffle 42 to deflect downwardly because of the weight (which, of course, is variable) of work 47 a water cooled, spring biased end support, indicated generally by reference numeral 50, is provided.

Figure 4:
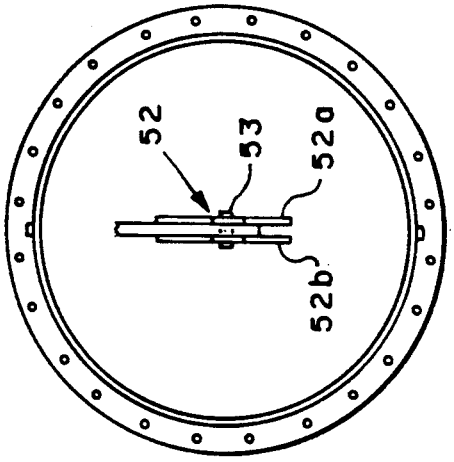
FIG. 4 is an end view of the rear of the muffle employed in the present invention.

End support 50 is best shown in FIGS. 2, 4, 12, 13 and 14 and includes an anchor pin support 52 best shown in FIGS. 2 and 4. Anchor pin support 52 includes 2 anchor pin support plates 52A. 52B welded to muffle closed end 44 and having a central opening through which an anchor pin 53 extends. A pivot bar 55 (FIGS. 2 and 12) has one of its ends attached to anchor pin 53 in a pivotal manner. The opposite end of pivot bar 55 extends through the top of heat treat casing 17.

Figure 12:
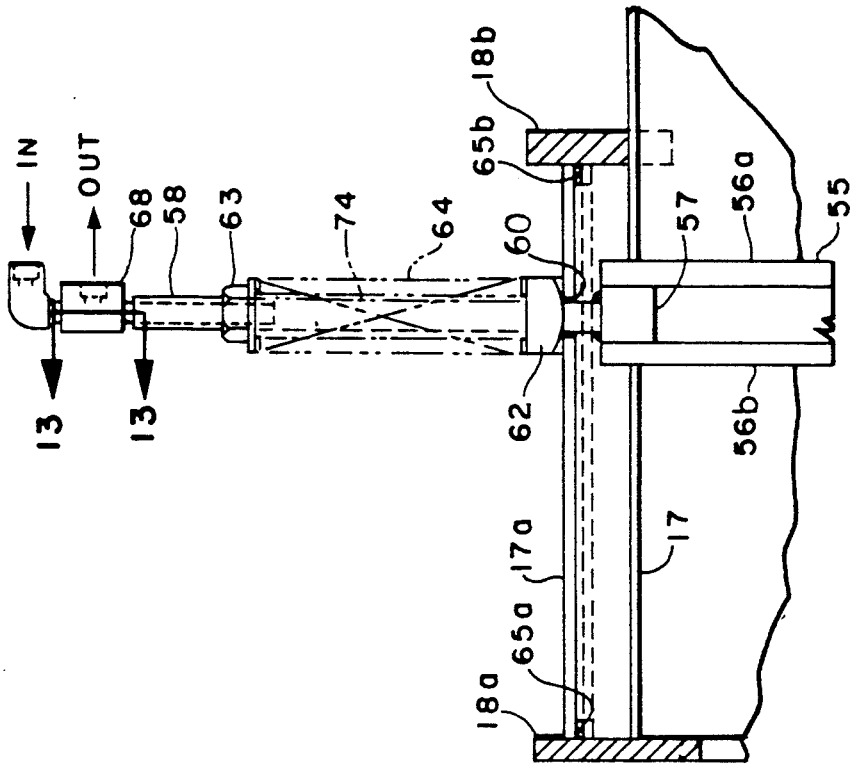
FIG. 12 is an enlarged, longitudinally-sectioned view of the pivot bar-spring arrangement of the invention.

Referring now to FIG. 12, pivot bar 55 generally includes two side members 56A, 56B joined at their ends just below heat treat casing 17 by a spacer block 57. Welded to and extending from spacer block 57 is a hollow tube 58 which extends through an opening 60 in heat treat casing 17. (In the preferred embodiment shown in FIGS. 2 and 12 a double wall heat treat casing 17, 17A is shown for rigidity. More specifically, a second casing 17A is secured to supports 18A, 18B and a ceramic rope seal 65A, 65B at each support 18A, 18B seals second heat treat casing section 17A, vis-a-vis the compressor force of spring 64 bearing against collar 62.) Slidably disposed over tube 58 is a hollow spherical sealing collar 62. Hollow tube 58 is threaded over its end protruding beyond heat treat casing 17 which is adapted to threadably receiving adjustable spring compression nut 63. A spring 64 is positioned over hollow tube 58 and compressed between compression nut 63 and sealing collar 62. Thus, end support 50 allows muffle 42 freedom of movement in that muffle 42 can pivot about anchor pin 53 while pivot bar 55 can also pivot about spherical sealing collar 62 at its other end. Spring 64 provides a support against downward movement of muffle 42 while also providing the means for effectively ensuring that sealing collar 62 is seated in a sealing manner against heat treat casing 17 to prevent loss or escape of products of combustion through opening 60. This arrangement also permits ease of assembly in that end support 50 can be easily inserted through opening 60 after muffle 42 or while muffle 42 is positioned in place. Spring 64 can then be appropriately tensioned by compression nut 63 to maintain muffle 42 in its proper attitudinal relationship within heat treat section 16.

Spring 64 cannot be subjected to furnace heat and must be cooled. In the present invention spring 64 is cooled outside heat treat section 16 and without adversely influencing the heat within heat treat section 16. As best shown in FIGS. 2, 12, 13 and 14, connector block 68 is sealingly threaded to hollow tube 58 at one end opening 69. In fluid communication with end opening 69 is a threaded water outlet 70 to which is attached a water drain pipe and also in fluid communication with end opening 69 is a water inlet 72. Sealingly secured in a threaded manner to water inlet 72 is a water supply tube 74 which extends within and through connector block 68, past end opening 69 and into hollow tube 58. Between water tube 74 and hollow tube 58 is an annular water space 75. Water tube 74 has a depth extending approximately the length of compression spring 64. Coolant is thus provided at water inlet 72 to water tube 74 and flows through annular water space 75 to water outlet 70. In this manner, compression spring 64 is effectively cooled to maintain its spring force without adversely influencing the heating within heat treat section 16. Thus, an effective spring biased load support is provided for muffle 42 which supports muffle 42 against downward deflection while permitting muffle 42 to thermally expand and contract while also providing for cooling of spring 64 without adversely influencing the temperature within heat treat section 16.

THE BULKHEAD

Referring now to FIG. 2, within heat treat casing 17 is a heat treat chamber 80. A stack indicated schematically by reference numeral 81 provides fluid communication between heat treat chamber 80 and atmosphere and a conventional, adjustable baffle (not shown) in stack 81 regulates pressure within heat treat chamber 80 in a conventional manner. Within plenum casing 20 is likewise a cylindrical plenum chamber 83. A fan motor 84 at the rear of plenum section 19 rotates a f an impeller 86 situated within the middle of plenum chamber 83. Fan impeller 86 can be of any shape though a paddle blade is illustrated. Fan impeller 86 operates in a conventional manner to develop a wind mass of either hot burner products of combustion, or, alternatively cooling air.

Figure 6:
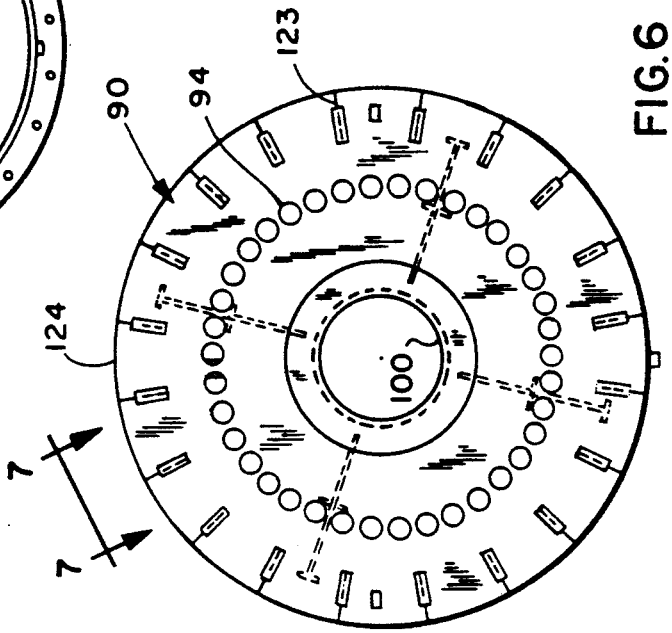
FIG. 6 is an end view of the bulkhead shown in FIG. 5.
Figure 5:
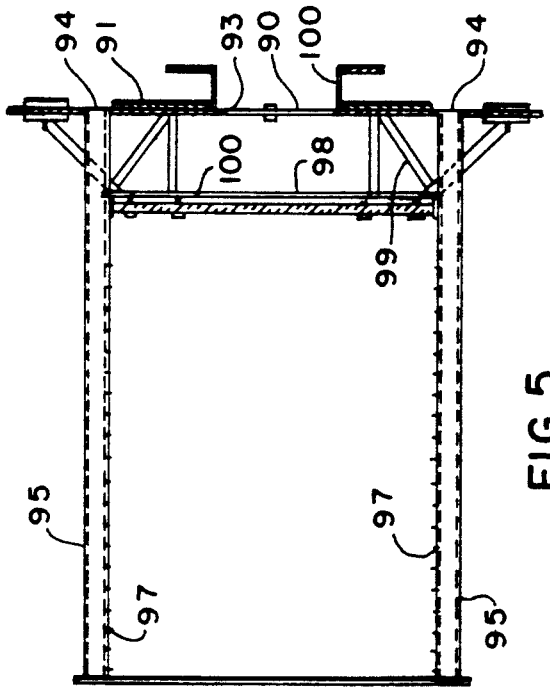
FIG. 5 is a longitudinally sectioned view of the bulkhead of the present invention with distributor tubes attached to the openings of the bulkhead.

Inbetween and separating plenum chamber 83 from furnace chamber 80 is a flat, circular plenum plate or bulkhead 90. On one side of bulkhead 90 within plenum chamber 83 insulation 91 is provided. As shown in FIG. 2, bulkhead 90 extends radially outwardly past furnace insulation 25 and is secured between heat treat section flange rearward end 22 and plenum section flanged forward end 23 in a manner which will be shortly described. As best shown in FIGS. 2, 5 and 6 bulkhead 90 has a centrally positioned, circular underpressure opening 93 and spaced radially outwardly from underpressure opening 93 is a plurality of circumferentially-spaced, pressure exit openings 94. Secured to each exit opening 94 is longitudinally-extending jet distributor tube 95. There thus is a plurality of distributor tubes 95 which longitudinally extend the length of heat treat chamber 80 and overlie in a concentric manner muffle 42. Each distributor tube 95 has a plurality of orifices 97 facing or opening to muffle 42 and which are spaced at somewhat equal longitudinal increments along the length of each distributor tube 95. An additional circular tube support plate 98 secured to bulkhead 90 by gussets 99 provides an additional support for jet distributor tubes 95. Support plate 98 does not have a central opening. Fluid communication is thus provided between plenum chamber 83 and heat treat chamber 80 by under pressure opening 93 and by exit openings 94 through distributor tubes 95 and orifices 97. In operation, impeller 86 creates a pressurized wind mass which exits plenum chamber 83 through exit openings 94, jet distributor tubes 95 and orifices 97 which in turn create a plurality of high speed jet streams that uniformly impinge muffle 42. After impact with muffle 42, the wind mass then returns to plenum chamber 83 through underpressure opening 93. In fact, an underpressure exists at underpressure opening 93. Reference should be had to my U.S. Pat. No. 4,830,610 for further explanation of this aspect of the invention. It should or must be noted that because orifices 97 direct high speed jet streams against muffle 42, it is possible to heat muffle 42 by convection and more effectively so at higher temperatures than that which is achieved by other furnace arrangements. Thus, while the invention contemplates application in a general sense to any high temperature batch furnace, the particular furnace illustrated has the ability to effectively use convective heat transfer at higher temperatures than that normally used in furnace applications because of the jet stream heating achieved by orifices 97.

As noted, bulkhead 90 extends from and between heat treat casing 17 and plenum casing 20 where the temperature is about 150° F. In contrast, the temperature of bulkhead 90 at positions radially inside of furnace insulation of furnace 25 is at high furnace temperatures of at least about 1700°-1750° F. Thus, a radial temperature gradient exists between the outer edge of bulkhead 90 and that portion of bulkhead 90 within plenum chamber 83 and heat treat chamber 80. Further, the wind mass developed by fan impeller 86 uniformly impinges against bulkhead 90. Further during the heat treat cycle, there are of course various temperatures to which bulkhead 90 is exposed. Thus, some provision has to be made to allow bulkhead 90 to radially expand and contract to account for radial stress gradations attributed to thermal and also pressure variations.

Figure 11:
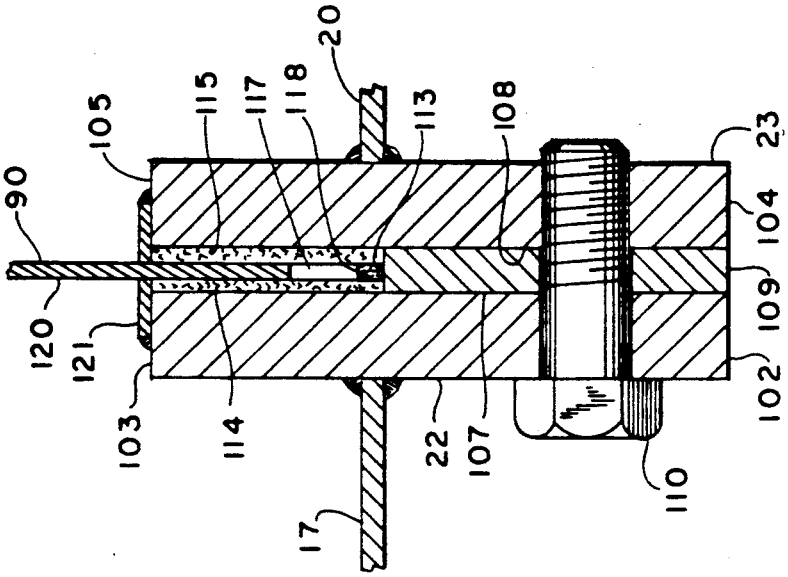
FIG. 11 is an enlarged, longitudinally-sectioned view better showing the flange connection between furnace sections generally illustrated in FIG. 2.

This is achieved in the present invention by first providing for an expansion joint connection at heat treat section flanged end 22 and plenum section flanged end section 23 as best shown in FIG. 11. Heat treat flange 22 is an annular member having an outside edge surface 102 and also a cylindrical inner edge surface 103. Similarly, plenum flange 23 is an annular member having an outside edge surface 104 and an inside edge surface 105. In addition, heat treat flange 22 has an annular end face surface 107 facing a similar end face surface 108 of plenum flange 23. Between end face surfaces 107, 108 is an annular spacer ring 109 extending from outside edge surfaces 102, 104 radially inwardly but stopping short of inside edge surfaces 103, 105. A plurality of circumferentially spaced fasteners 110 secure heat treat flange 22, spacer ring 109 and plenum flange 23 together. A conventional high temperature grease is provided between spacer ring 109 and heat treat flange 22 and spacer ring 109 and plenum flange 23 for sealing purposes. As thus described, an annular receiving space 112 exists between end face surface 107 and end face surface 108 and radially extending from inside circular edge surface 113 of spacer ring 109 to the inside edge surfaces 103, 104 of heat treat flange 22 and plenum flange 23 respectively. Within annular space 112 adjacent end face surface 107 of heat treat flange 22 is a conventional, annular, ceramic fibre gasket 114. Similarly, a second annular fibre gasket 115 is adjacent end face surface 108 of plenum flange 23. (Actually, each annular fibre gasket 114, 115 is made up of 90° curve segments glued by fibre gasket cement to end face surfaces 107, 108.) With gaskets 114, 115 in place as shown annular space 112 is reduced to an annular slit 117 and into annular slit 117 is placed, snugly, the radial outer edge portion of bulkhead 90. Finally, a circular, ceramic rope seal 118 between fibre gaskets 114, 115 adjacent edge surface 113 and spacer ring 109 seals annular slit 117. Fibre gaskets 114, 115 while clamping the side faces 120 of bulkhead 90 nevertheless permit bulkhead 90 to radially expand inwardly and outwardly as a result of heat and pressure. Finally, welded to inside edge surface 103 of heat teat flange 22 and inside edge surface 105 of plenum flange 23 are circular guide plates 121.

It is to be appreciated that bulkhead 90 is a large flat circular plate which is subjected to pressure and thermal gradients and at elevated temperatures can become warped. In general heat treat furnaces having a cylindrical construction with a bulkhead inbetween and dividing the heat treat chamber from the plenum chamber, distortion or warping of the bulkhead will change the direction in which the wind mass leaves the exit openings. In the particular furnace utilizing the present invention, distributor tubes 95, because of their length, can and will change their positions relative to muffle 42 should bulkhead 90 become warped or distended in its configuration. This can effect the jet stream heat transfer to muffle 42 and conceivably, produce "hot spots" on muffle 42 etc.

Figure 10:
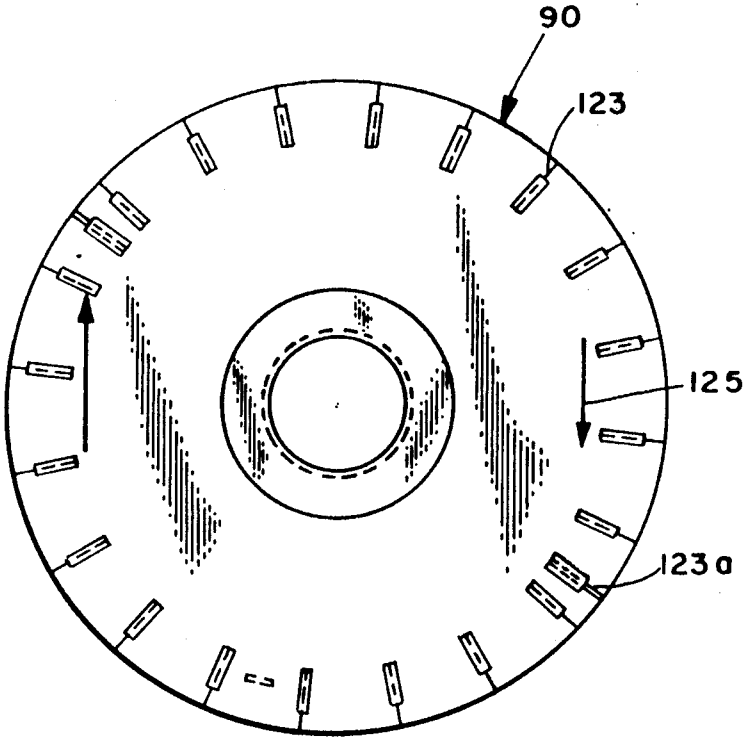
FIG. 10 is an end view of the bulkhead showing an alternative slit arrangement.

Referring now to FIGS. 6 and 10 and in accordance with the invention bulkhead 90 is provided with a plurality of radially extending slits 123. In the preferred embodiment, the slits are circumferentially spaced in equal increments about bulkhead 90 and as noted are radial in the sense in that if they were extended they would intersect the center of bulkhead 90. Each slit starts at a position spaced radially outwardly from pressure exit openings 94 and extends to the outer edge 124 of bulkhead 90. In practice, a plurality of slits are required. Further, as shown in FIG. 10 with tangentially fired burners 28, 29 the hot products of combustion will initially impact bulkhead 90 at two positions 180° spaced from one another and then slightly cool in temperature as the products of combustion continue to swirl about plenum chamber 83. This can, in turn, produce hot spots over discrete portions of bulkhead 90. In FIG. 10 the direction of the burner products of combustion is indicated by vector arrows 125 and to compensate for plate warpage tendencies at the hot spots, an additional radial slit 123a is positioned between two adjacent radial slits 123. Thus, in the modified embodiment of the slit configuration shown in FIG. 10 there are two additional radial slits 123a inserted 180° apart i.e. at 4:00 and 10:00. The additional radial slits 123a compensate for the initial, high temperature impact attributed to tangentially fired burners which can cause an additional "warpage" of bulkhead 90.

Figure 7:
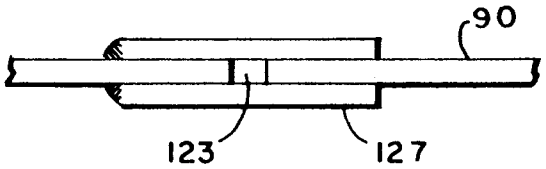
FIG. 7 is an end view of a portion of the bulkhead showing the slit cover mechanism taken along lines 7—7 of FIG. 6.
Figure 13:
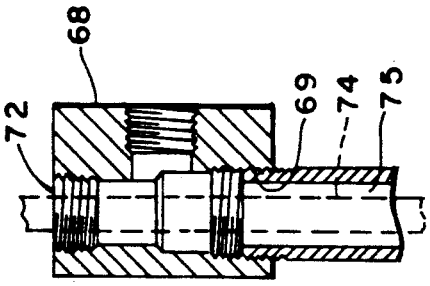
FIG. 13 is a sectioned view showing the water inlet-outlet arrangement employed in the spring retention mechanism illustrated in FIG. 12 taken along lines 13—13 of FIG. 12.
Figure 14:
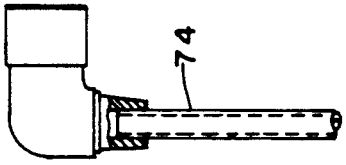
FIG. 14 is a diagrammatic illustration of the water tube used in the spring retention mechanism of FIG. 12.

The presence of slits 123 unfortunately also provide a source of leakage of the wind pressure from plenum chamber 83 to heat treat chamber 80. To minimize the leakage, cover plates 127 are provided on both side faces 120 of bulkhead 90. As shown in FIG. 7, cover plates 127 can simply be welded to side faces 120. Cover plates 127 have a length which extend from the radially innermost edge of slits 123 towards guide plates 121 stopping some slight distance from guide plates 121 to permit expansion of bulkhead 90.

Figure 9:
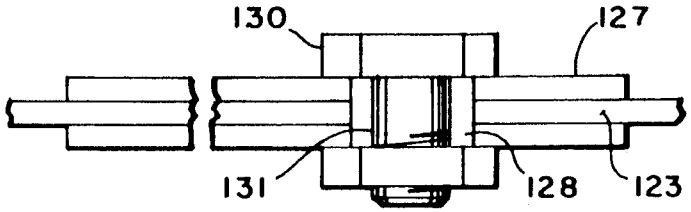
FIG. 9 is a sectioned view of the alternative embodiment of the slit cover arrangement shown in FIG. 8 taken along lines 9—9 of FIG. 8.
Figure 8:
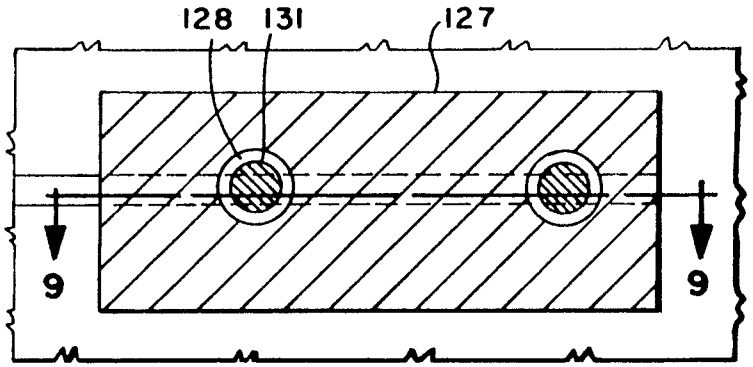
FIG. 8 is a partially sectioned end view of the bulkhead showing an alternative embodiment of a slit cover arrangement.

An alternative arrangement is disclosed in FIGS. 8 and 9. In the alternative arrangement cover plates 127 are positioned over radial slit 123 and two holes 128 are drilled through cover plates 127 and slit 123 thus widening slit 123. Fasteners 130 are then used to secure cover plates 127 together. The shanks 131 of fastener 130 are sized to be smaller than the diameter of holes 128 to permit slop or movement of cover plates 127 relative to bulkhead 90. With this alternative arrangement, the cover plates can be positioned (in an assembled or installed condition) closely adjacent guide plates 121 to minimize leakage while still allowing free expansion and contraction of bulkhead 90.

ADDITIONAL DESCRIPTION

The high temperature gas fired vacuum furnace has several design requirements that are significantly more severe at 1750° than at 1250° F.

The combustion chamber is pressurized by the recirculation fan and a pressurized mixture of combustion products and recirculating flue products are pushed into the recirculation manifold. The over pressure developed by the fan is applied over the entire area of the bulkhead separating the high pressure region from the low pressure region. The bulkhead has been designed as a flat membrane with an opening at its center f or the inlet opening of the f an and a circle of openings into which the recirculation tubes have been welded.

The pressure force exerted by the fan is considerable due to the large area of the membrane. The resulting stresses must be kept low due to the high temperatures of the membrane and the low allowable creep stresses which can be used in the design.

The bulkhead must remain flat during extended operation. Two influences can lead to a permanent deflection of the bulkhead. One is caused by the previously described pressure force. The other is caused by thermal stresses resulting from temperature gradients in the membranes. It is a common experience that large flat plates are deformed (warped) when heated non-uniformly or when heated to final non-uniform temperatures. This deformation is permanent and becomes additive after repeated cycling.

The bulkhead has been designed such that this deformation will not occur. The circular bulkhead is cut along a large number of radii to form radial segments that are pie shaped. The radial cuts are only made in the area where temperature gradients can be expected. In the area surrounding the fan inlet opening these cuts are terminated. The cuts form small slots that are permeable for gases. To limit leakage the slots are covered by flat strips that are welded on one side only to the bulkhead.

To transfer the axial pressure load on the bulkhead a special design needed to be implemented that transfers the load to the outer shell of the furnace without transferring a large amount of heat to the outside. The bulkhead is keyed to the outside and is held between two insulating flanges. The flatness of the bulkhead has been checked repeatedly after a large number of heating and cooling cycles were run and has remained flat.

The horizontal vacuum furnace supports the work load from the bottom of the vacuum vessel. Concern has been raised that at the extremely high temperatures the bending stresses in the outer, uppermost fiber might exceed the safe creep stress limits of the vessel material. To counter this concern a support has been added to the rear of the vacuum vessel. The support applies an upwardly directed force to the rear of the vessel and is applied in the center of the domed head closing the rear of the vessel. A constant upward force is applied by a spring that is attached to the outside of the vessel. From the cold, water-cooled spring the force is transmitted by a load bearing member that remains hot on the end attached to the vessel and cold at the end supported by the spring. Independent of the changing temperature of the load support a major upward force is exerted on the vessel. At the highest temperature this support force is adjusted by measuring the torque required to exert a force of 2000 pounds.

Conventional vacuum furnaces have water cooled outer shells. They do not emit heat into the environment when operating. This is a very attractive feature that is difficult to implement on an insulated furnace. Reducing skin temperatures to low levels becomes very expensive as hot face temperatures increase. Calculations showed that more than two feet of fiber insulation were required to bring temperatures below 120° F.

Instead of adding additional insulation an outer second skin was added to the furnace. This skin forms a narrow annular space around the outer furnace. The combustion air f or the burners is drawn between the outer skin and the furnace shell. This air keeps the outer skin temperature at levels well below 100° F. and additionally recovers waste heat by returning heat losses from the furnace walls to the combustion air and into the furnace.

The invention has been described with reference to a preferred embodiment and alternative embodiments. Further alterations and modifications will occur to those skilled in the art upon reading and understanding the detailed description of the invention. It is intended to cover all such modifications and alterations in-so-far as they come within the scope of the invention.

Having thus described the invention, it is now claimed:

1. A cylindrical, high temperature industrial heat treat furnace comprising:

a heat treat section defined by a generally cylindrical furnace casing having a circular forward end and a flanged, rearward end, said forward end being the loading end of said furnace;

a plenum section defined by a generally cylindrical plenum casing having a circular flanged forward end and a rearward end, said rearward end being the rear end of said furnace;

said flanged forward end of said furnace casing and said flanged rearward end of said plenum casing abutting one another in a secured manner;

a circular bulkhead having outer edge face surfaces inbetween said flanged ends and defining a heat treat chamber extending f rom one side of said bulkhead within said heat treat section and a plenum chamber extending from the opposite side of said bulkhead within said plenum section; said bulkhead having a central underpressure opening and a pressure exit opening spaced radially outwardly from said central opening, fan means within said plenum chamber f or developing a source of pressurized wind mass within said plenum chamber leaving said plenum chamber through said pressure exit opening into said heat transfer chamber and returning to said plenum chamber through said central opening;

burner means for heating said wind mass to an elevated temperature;

sealing means at said flanged ends for sealing said circular outer edge face surfaces of said bulkhead within said flanged ends while permitting said bulkhead edge to radially move within said flanged ends to accommodate thermal expansion and contraction; and at least one radial slit formed in said bulkhead extending to the outer edge of said bulkhead from a position radially outwardly from said pressure opening whereby said bulkhead remains flat despite expansion and contraction.

2. The furnace of claim 1 wherein a plurality of radial slits are formed and circumferentially spaced about said bulkhead so that adjacent slits form trapezoid shaped configurations whereby said bulkhead remains flat during operation of said furnace.

3. The furnace of claim 2 wherein said slits are spaced in equal circumferential increments about said bulkhead.

4. The furnace of claim 3 wherein said burner means includes first and second burners oriented to fire generally tangentially to said plenum casing within said plenum chamber, said burners spaced 180° from one another, and said bulkhead further includes additional first and second radial slits circumferentially spaced 180° from one another, each additional slit closely adjacent a slit spaced at equal circumferential increments.

5. The furnace of claim 2 further including a plurality of said pressure exit openings spaced at equal, circumferential increments about said bulkhead.

6. The furnace of claim 5 further including a cylindrical, closed end muffle disposed within said heat treat chamber with the open end of said muffle approximately aligned with said forward end of said heat treat section, and a plurality of longitudinally-extending jet distributor tubes extending from said pressure exit openings into said heat treat chamber and circumscribing said muffle; each distributor tube containing a plurality of orifices orientated so that jet streams of said wind mass pressurized from said plenum chamber impinge said muffle.

7. The furnace of claim 2 further including cover means for each slit covering at least some portion of each slit so that said wind mass developed by said fan in said plenum chamber does not substantially exit said plenum chamber and enter into said heat treat chamber through said slits.

8. The furnace of claim 6 further including said closed end of said muffle being spherically or nonspherically shaped; an anchor pin secured to and extending from said closed end; a pivot bar attached at one end to said anchor pin in a pivotal manner; a spherical collar mounted adjacent said heat treat casing for swiveling, said collar having a central opening in communication with an opening through said heat treat casing and through which said pivot bar extends; an adjustable compression member mounted on said pivot bar above said collar; a spring effectively compressed between said compression member and said heat treat casing by which said closed end of said muffle is pulled upwardly by the compression force of said spring whereby said muffle is supported against downward deflection at elevated temperature by said spring.

9. The furnace of claim 8 wherein said pivot rod is hollow over that distance which said pivot rod extends beyond said heat treat casing; a water tube connected to a water supply inlet within the hollow portion of said pivot rod and defining an annular water space between said water tube and said pivot rod; and a water outlet in fluid communication with said annular water space generally adjacent said water inlet whereby said spring is maintained cool without adversely effecting the temperature within said heat treat chamber.

10. The furnace of claim 8 wherein said muffle is formed as a thin wall imperforate member with wall thickness of about 5/16".

11. The furnace of claim 1 further including a heat shield circumscribing a substantial portion of the circumference of said heat treat section and extending substantially the length of said heat treat section, said heat shield and said heat treat casing forming an annular cooling space therebetween, said annular cooling space in fluid communication at said rearward end of said heat treat section with said blower and said burner means in said plenum chamber and in fluid communication at said forward end of said heat treat section with combustion air whereby combustion air is preheated by said heat treat casing while simultaneously cooling said furnace casing to minimize furnace insulation otherwise required to keep said heat treat casing cool when said heat treat chamber is at elevated temperatures in excess of about 1700° F.

12. The furnace of claim 11 further including air nozzles within said plenum chamber for developing wind mass at relatively cool temperatures when said furnace is operated to cool work within said heat treat chamber, said air nozzles in valved fluid communication with said annular cooling space and said air nozzles oriented to direct cooling air emanating from said nozzles generally tangential to said plenum casing whereby said cooling air swirls about said plenum chamber.

13. The furnace of claim 2 wherein said cover means includes a first cover plate on one side of said bulkhead and a second cover plate on the opposite side of said bulkhead, first and second pins of a first diameter, at least one of said plates having first and second holes of a second diameter larger than said first diameter, said pins extending from one plate through said other plate f or securing said plates to one another whereby said plates can be initially positioned when assembling said furnace to be closely adjacent said flanged ends to effectively block said slits.

14. The furnace of claim 2 further including an annular spacer ring having an inside circular edge and an outside circular edge between said flanged ends of said heat treat section and said plenum section, said flanged ends each having an inside edge and an outside edge, said spacer ring adjacent the outside edges of said flanged ends and extending radially inwardly a fixed distance to define a receiving annular space extending from said spacer ring to said inside circular edge of said flanged ends, heat resistant gaskets within said receiving space adjacent said heat treat flanged end and said plenum flanged end to define within said annular space an annular slit space receiving said outer edge face surfaces of said bulkhead adjacent said bulkhead's outer edge in a yieldable manner to permit said bulkhead to radially expand and contract while firmly gripping said bulkhead.

15. The furnace of claim 14 further including a rope type seal adjacent said spacer ring between said heat resistant gaskets and a circular guide plate adjacent said inside edges of said flanged ends, said guide plate having an annular guide opening overlying said annular slit space through which said bulkhead passes.

16. A cylindrical high temperature industrial heat treat furnace comprising:

a cylindrical heat treat section having an open forward end and a rearward end defined by a cylindrical heat treat, gas tight casing and fibrous furnace insulation secured about the interior of said heat treat casing to define a heat treat chamber therein;

a cylindrical closed end plenum section secured to said rearward end of said heat treat section, a closed end, cylindrical, imperforate muffle having a flanged forward end, said flanged forward end adjacent said forward end of said heat treat section and said muffle's closed end within said heat treat chamber;

an anchor pin secured to and extending from said closed end; a pivot bar attached at one end to said anchor pin in a pivotal manner; a spherical collar mounted adjacent said heat treat casing for swiveling, said collar having a central opening in fluid communication with an opening in said heat treat casing and through which said pivot bar extends; an adjustable compression member mounted on said pivot bar;

a spring effectively compressed between said compression member and said heat treat casing by which said closed end of said muffle is pulled upwardly by the compression force of said spring whereby said muffle is supported against downward deflection at elevated temperature by said spring.

17. The furnace of claim 16 wherein said pivot rod is hollow over that distance which said pivot rod extends beyond said heat treat casing; a water tube connected to a water supply inlet within the hollow portion of said pivot rod and defining an annular water space between said water tube and said pivot rod; and a water outlet in fluid communication with said annular water space generally adjacent said water inlet whereby said spring is maintained cool without adversely effecting the temperature within said heat treat chamber.

18. The furnace of claim 16 wherein said muffle is formed as thin wall imperforate member with wall thickness of about 5/16.

19. The furnace of claim 16 further including a heat shield circumscribing a substantial portion of the circumference of said heat treat section and extending substantially the length of said heat treat section, said heat shield and said heat treat casing forming an annular cooling space therebetween, said annular cooling space in fluid communication at said rearward end of said heat treat section with said burner means in said plenum chamber and in fluid communication at said forward end of said heat treat section with combustion air whereby combustion air is preheated by said heat treat casing while simultaneously cooling said heat shield to minimize furnace insulation otherwise required to keep said heat treat casing cool when said heat treat chamber is at elevated temperatures in excess of about 1700° F.

20. The furnace of claim 19 wherein said fibrous insulation within said furnace casing partially supports said muffle adjacent said forward end thereof.

21. A cylindrical high temperature industrial heat treat furnace comprising a cylindrical heat treat section having a forward and rearward end and defining therein a heat treat chamber;

a cylindrical plenum section sealingly secured to said heat treat casing and defining a cylindrical plenum chamber therein;

a cylindrical closed end, imperforate muffle within said heat treat chamber having a work receiving open end adjacent said heat treat section forward end;

a circular bulkhead in-between said heat treat and said plenum sections having a central under-pressure opening and a plurality of distributor tube pressure exit openings spaced radially outwardly from said return opening, a plurality of distributor tubes secured to said exit openings and longitudinally extending within said heat treat chamber, each distributor tube having a plurality of jet openings facing said muffle;

fan means and burner means within said plenum chamber for developing a source of wind mass at high pressure and temperatures in excess of about 1700° F. within said plenum chamber, said wind mass exiting said plenum chamber through said exit openings and returning through said central opening, and a plurality of circumferentially spaced, radially-extending slits formed in said bulkhead extending from a position radially outwardly of said exit openings to the outer edge of said bulkhead; and slip joint means between said plenum and heat treat sections allowing said bulkhead to expand and contract during operation of the furnace while retaining said bulkhead.

22. The furnace of claim 21 wherein a said plenum section has a flanged forward end, said forward end of said heat treat section is flanged, said bulkhead has a circular outer edge and outer edge face surfaces adjacent said outer edge, said outer edge faces of said bulkhead clamped between said flanged ends of said plenum and heat treat sections.

23. The furnace of claim 22 wherein said slits are spaced in equal circumferential increments about said bulkhead.

24. The furnace of claim 23 wherein said burner means includes first and second burners oriented to file generally tangentially to said plenum casing within said plenum chamber, said burners spaced 180° from one another, and said bulkhead further includes additional first and second radial slits circumferentially spaced 180° from one another, each additional slit closely adjacent a slit spaced at equal circumferential increments.

25. The furnace of claim 22 further including cover means for each slit covering at least some portion of each slit so that said wind mass developed by said f an in said plenum chamber does not substantially exit said plenum chamber and enter into said heat treat chamber through said slits.

26. The furnace of claim 22 wherein said cover means includes a first cover plate on one side of said bulkhead and a second cover plate on the opposite side of said bulkhead, first and second pins of a first diameter, at least one of said plates having first and second holes of a second diameter larger than said first diameter, said pins extending from one plate through said other plate for securing said plates to one another whereby said plates can be initially positioned when assembling said furnace to be closely adjacent said flanged ends to effectively block said slits.

27. The furnace of claim 21 further including an annular spacer ring having an inside circular edge and an outside circular edge between said flanged ends of said heat treat section and said plenum section, said flanged ends each having an inside edge and an outside edge, said spacer ring adjacent the outside edges of said flanged ends and extending radially inwardly a fixed distance to define a receiving annular space extending from said spacer ring to said inside circular edge of said flanged ends, heat resistant gaskets within said receiving space adjacent said heat treat flanged end and said plenum flanged end to define within said annular space an annular slit space receiving the face surfaces of said bulkhead adjacent said bulkhead's outer edge in a yieldable manner to permit said bulkhead to radially expand and contract while firmly gripping said bulkhead.

28. The furnace of claim 27 further including a rope type seal adjacent said spacer ring between said heat resistant gaskets and a circular guide plate adjacent said inside edges of said flanged ends, said guide plate having an annular guide opening overlying said annular slit space through which said bulkhead passes.

29. The furnace of claim 21 further including a heat shield circumscribing a substantial portion of the circumference of said heat treat section and extending substantially the length of said heat treat section, said heat shield and said heat treat casing forming an annular cooling space therebetween, said annular cooling space in fluid communication at said rearward end of said heat treat section with said burner means in said plenum chamber and in fluid communication at said forward end of said heat treat section with combustion air whereby combustion air is preheated by said heat treat casing while simultaneously cooling said heat shield to minimize furnace insulation otherwise required to keep said heat treat casing cool when said heat treat chamber is at elevated temperatures in excess of about 1700° F.

* * * * *